US012454901B2

(12) United States Patent
Schmidt et al.

(10) Patent No.: US 12,454,901 B2
(45) Date of Patent: Oct. 28, 2025

(54) SOUND DAMPER

(71) Applicant: Purem GmbH, Neunkirchen (DE)

(72) Inventors: Michael Schmidt, Friedrichsthal (DE); Philipp Kratz, St. Ingbert (DE)

(73) Assignee: Purem GmbH, Neunkirchen (DE)

( * ) Notice: Subject to any disclaimer, the term of this patent is extended or adjusted under 35 U.S.C. 154(b) by 113 days.

(21) Appl. No.: 18/473,962

(22) Filed: Sep. 25, 2023

(65) Prior Publication Data

US 2024/0102407 A1 Mar. 28, 2024

(30) Foreign Application Priority Data

Sep. 26, 2022 (DE) ..... 10 2022 124 582.9

(51) Int. Cl.
*F01N 1/02* (2006.01)

(52) U.S. Cl.
CPC ..... *F01N 1/023* (2013.01); *F01N 2470/02* (2013.01)

(58) Field of Classification Search
CPC ... F01N 1/023; F01N 2470/02; F01N 2470/18
See application file for complete search history.

(56) References Cited

U.S. PATENT DOCUMENTS 4,360,076 A 11/1982 Suyama
6,457,553 B1 * 10/2002 Goplen ..... F01N 13/1838 181/212
8,051,949 B2 * 11/2011 Henke ..... F01N 1/08 181/251
8,205,713 B2 * 6/2012 Gorke ..... F01N 13/1838 181/227
8,205,716 B2 * 6/2012 Wirth ..... F01N 13/185 181/269
9,546,587 B2 * 1/2017 Kobe ..... F01N 13/1827
10,196,947 B2 * 2/2019 LeRoy ..... F01N 1/023
10,267,207 B2 * 4/2019 Krause ..... F01N 13/1844
11,215,105 B2 * 1/2022 Hayakawa ..... F01N 13/16
2002/0066619 A1 6/2002 Collmer et al.
2019/0120115 A1 4/2019 Zdravkov
2022/0389848 A1 * 12/2022 Beck ..... F01N 13/18
2022/0403765 A1 * 12/2022 Krause ..... F01N 1/023
2023/0024144 A1 1/2023 Straehle et al.

FOREIGN PATENT DOCUMENTS

DE 27 13 120 A1 10/1977
DE 100 60 522 A1 6/2002
DE 10 2009 023 029 A1 12/2010
DE 10 2009 053 429 A1 9/2011
(Continued)

*Primary Examiner* — Jeremy A Luks
(74) *Attorney, Agent, or Firm* — Walter Ottesen

(57) ABSTRACT

A sound damper for an exhaust gas system of an internal combustion engine includes a sound damper housing, at least one intermediate wall which is arranged in a housing interior and at least one sound damper connection pipe. The sound damper connection pipe is supported in a first pipe end region on the sound damper housing and is arranged in a second pipe end region on a support element which is arranged in the housing interior. The support element forms an integral component of an intermediate wall. The sound damper connection pipe introduces exhaust gas into the housing interior or directs exhaust gas out of the housing interior.

16 Claims, 2 Drawing Sheets

(56) References Cited

FOREIGN PATENT DOCUMENTS

| | | | | | |
|---|---|---|---|---|---|
| DE | 102010052468 | A1 * | 5/2012 | ..... | F01N 1/026 |
| DE | 102011106366 | A1 * | 12/2012 | ..... | F01N 1/089 |
| DE | 102010015322 | B4 * | 7/2013 | ..... | F01N 1/006 |
| EP | 1 178 187 | A1 | 2/2002 | | |
| EP | 2375017 | A2 * | 10/2011 | ..... | F01N 1/02 |
| EP | 3 473 823 | A1 | 4/2019 | | |
| EP | 4 124 731 | A1 | 2/2023 | | |
| JP | 2009-92033 | A | 4/2009 | | |
| WO | 2011/061213 | A1 | 5/2011 | | |

* cited by examiner

SOUND DAMPER

CROSS-REFERENCE TO RELATED APPLICATIONS

This application claims priority of German patent application no. 10 2022 124 582.9, filed Sep. 26, 2022, the entire content of which is incorporated herein by reference.

TECHNICAL FIELD

The present disclosure relates to a sound damper for an exhaust gas system of an internal combustion engine, including a sound damper housing, at least one intermediate wall which is arranged in a housing interior and at least one sound damper connection pipe for introducing exhaust gas into the housing interior or for directing exhaust gas out of the housing interior.

BACKGROUND

Such a sound damper connection pipe, which can be used as an inlet pipe for introducing exhaust gas into the housing interior or can be used as an outlet pipe for directing exhaust gas out of the housing interior, is generally supported with one of the pipe end regions thereof on the sound damper housing and fixed in order to provide a gas-tight closure, for example, by welding.

SUMMARY

An object of the present disclosure is to provide a sound damper for an exhaust gas system, wherein a sound damper connection pipe which is used as an inlet pipe or as an outlet pipe can be easily supported in a stable manner in the pipe end region thereof which is located in a housing interior of a sound damper housing.

This object is achieved according to the disclosure by a sound damper for an exhaust gas system of an internal combustion engine, including

- a sound damper housing,
- at least one intermediate wall which is arranged in a housing interior,
- at least one sound damper connection pipe, which is supported in a first pipe end region on the sound damper housing and which is arranged in a second pipe end region on a support element which is arranged in the housing interior and which forms an integral component of an intermediate wall, for introducing exhaust gas into the housing interior or for directing exhaust gas out of the housing interior.

Intermediate walls which are arranged inside a sound damper housing are used to subdivide the housing interior into a plurality of chambers which support a defined exhaust gas flow in the housing interior and/or to support pipes which extend inside the sound damper housing. By providing a support element for supporting a sound damper connection pipe which is used as an inlet pipe or as an outlet pipe as an integral component of such an intermediate wall, on the one hand, a stable configuration is achieved and, on the other hand, the structural complexity is minimized because no measures are required to connect such a support element to an intermediate wall.

In this context, it may be noted that, in the context of the present disclosure, the integral configuration of two components, particularly the support element with an intermediate wall, means that the components involved are provided as a single, for example, substantially monolithic material block, and are not in the form of separate components and joined together by a connection operation.

One intermediate wall, that is, the intermediate wall which provides the support element for the associated sound damper connection pipe, may include a wall member which is located substantially in an intermediate wall plane, that is, consequently, may be constructed in a substantially plate-like and planar manner, and the support element may extend from the wall member out of the intermediate wall plane.

In order to achieve the configuration, which is angled with respect to each other, of the wall member and the support element, it is proposed that the support element adjoin the wall member in a bending region and be bent out of the intermediate wall plane in the bending region.

In this case, the support element can extend in a substantially orthogonal manner to the intermediate wall plane, which is particularly advantageous when the sound damper housing includes a circumferential wall which is elongate in the direction of a longitudinal housing axis and an end wall at both axial ends of the circumferential wall and the intermediate wall plane is arranged substantially orthogonally to the longitudinal housing axis. This also allows such an orientation of the sound damper connection pipe with respect to the intermediate wall which has the support element and in which a mutual interference of the intermediate wall or intermediate wall member, on the one hand, and the sound damper connection pipe, on the other hand, is avoided.

For a configuration which is structurally simple to carry out, the at least one sound damper connection pipe may be elongate in the direction of a longitudinal pipe axis and the support element may extend substantially orthogonally to the longitudinal pipe axis. Consequently, it can be ensured that the sound damper connection pipe cooperates in a supporting manner with the support element at the second pipe end region thereof over the entire circumference thereof in the same manner.

The longitudinal pipe axis can extend substantially parallel with the intermediate wall plane so that the at least one sound damper connection pipe has substantially identical spacing from the intermediate wall member in the entire extent region thereof.

In order to ensure a defined positioning of the sound damper connection pipe with respect to the support element, the support element may have a formation region which engages round the second pipe end region of the at least one sound damper connection pipe and/or which engages in the second pipe end region of the sound damper connection pipe.

The axial discharge of exhaust gas at the second pipe end region can be prevented in that the at least one sound damper connection pipe is closed by the support element at the second pipe end region thereof.

To this end, for example, there may be provision for the at least one sound damper connection pipe to be closed at the second pipe end region thereof by the formation region which engages in the second pipe end region.

In order to hold together the sound damper connection pipe with the support element in a stable manner, alternatively or additionally to the above-mentioned positive-locking connection the at least one sound damper connection pipe can be fixed in the second pipe end region thereof to the support element by material engagement, preferably welding.

The at least one sound damper connection pipe can be received with the first pipe end region thereof in an opening of the sound damper housing so that in a simple manner a connection to pipe-like components, which extend outside the sound damper, of an exhaust gas system can be produced. In order to achieve a stable configuration, the at least one sound damper connection pipe can further be fixed in the first pipe end region thereof by material engagement, preferably welding, to the sound damper housing.

Particularly with exhaust gas systems with great dimensions, it may be advantageous if the sound damper connection pipe is supported between the first pipe end region and the second pipe end region thereof by at least one additional support element which forms an integral component of the intermediate wall.

To this end, the at least one additional support element may have a formation region which engages round the sound damper connection pipe.

The disclosure further relates to an exhaust gas system for an internal combustion engine of a vehicle including at least one sound damper which is constructed according to the disclosure.

BRIEF DESCRIPTION OF DRAWINGS

The invention will now be described with reference to the drawings wherein.

DETAILED DESCRIPTION

Figure 1:
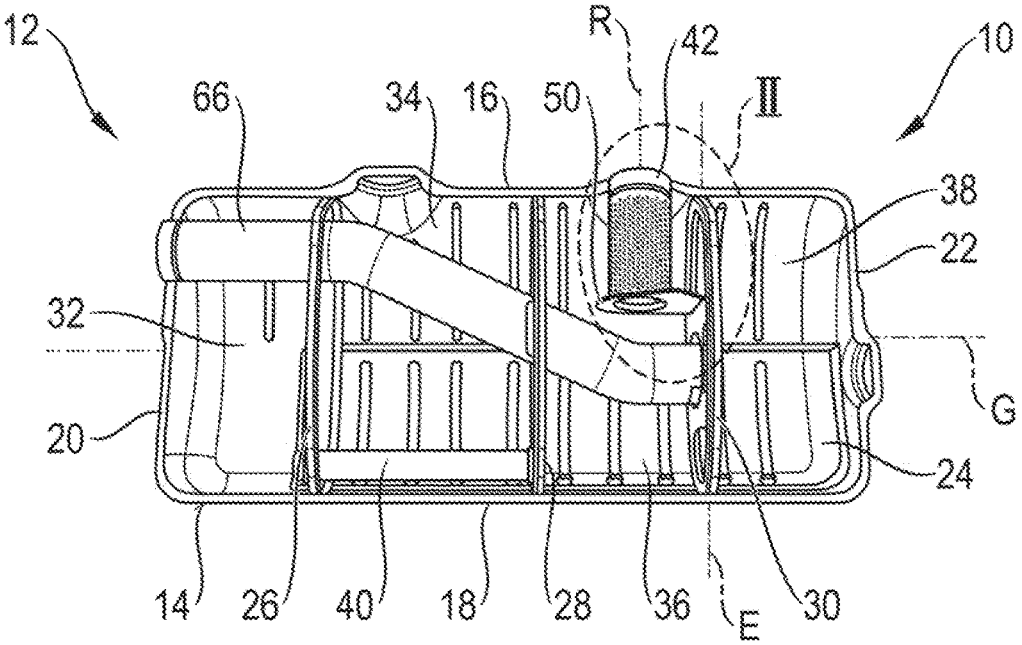
FIG. 1 shows a plan view of a sound damper with a sound damper housing which is illustrated in the open state.
Figure 2:
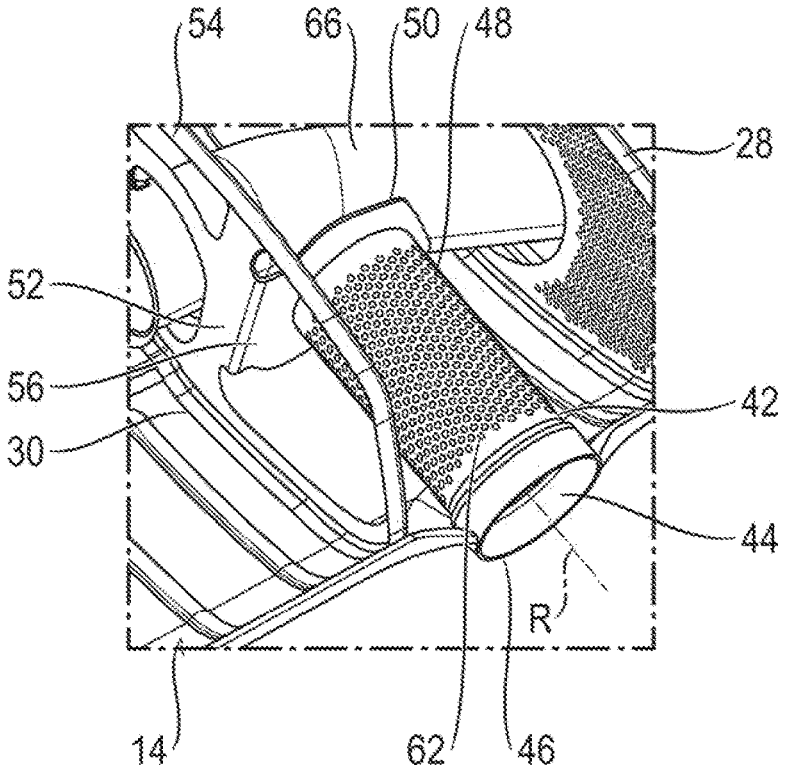
FIG. 2 shows a detailed view of the sound damper of FIG. 1 in the region II in FIG. 1.

FIG. 1 shows a sound damper 10 of an exhaust gas system which is generally designated 12 for an internal combustion engine in a vehicle having a sound damper housing 14 which is illustrated in the open state. In the embodiment illustrated, the sound damper housing 14 is configured with two housing shells which are constructed, for example, substantially symmetrically to each other and of which FIG. 1 shows only the housing shell 16.

The sound damper housing 14 is elongate in the direction of a longitudinal housing axis G and includes a circumferential wall 18 which surrounds the longitudinal housing axis G and which is substantially elongate in the direction of the longitudinal housing axis G and, at both axial ends of the circumferential wall 18, an end wall 20, 22. In a housing interior 24 which is surrounded by the sound damper housing 14, in the embodiment illustrated three intermediate walls 26, 28, 30 are arranged. As a result of the intermediate walls 26, 28, 30, the housing interior 24 is subdivided into four chambers 32, 34, 36, 38 in principle. In this case, the intermediate walls 26, 28, 30 can be constructed with openings which connect the chambers which are thereby separated from each other, or one or more of the intermediate walls can be constructed substantially without one or more such openings so that at least one chamber can be used as a resonator chamber of a Helmholtz resonator. In the embodiment illustrated, for example, the chamber 32 which is delimited between the end wall 20 and the intermediate wall 26 can be such a resonator chamber which is open via a pipe 40, which extends through the intermediate wall 26 and which provides a resonator neck, to the chambers 36 which are formed between the two intermediate walls 28, 30.

In this context, it may be noted that FIG. 1 shows only one embodiment of a sound damper 10 with regard to the number and positioning of the intermediate walls and also the direct communication, which is permitted or prevented thereby, of adjacent chambers. It is evident that the number, position and function of the intermediate walls may differ from the embodiment illustrated in FIG. 1.

The sound damper 10 has a sound damper connection pipe 42 which acts in the embodiment illustrated as an inlet pipe. The sound damper connection pipe 42 is received with a first pipe end region 44 in an opening 46 which is constructed in the circumferential wall 18 of the sound damper housing 14. This opening 46 can be formed partially in the housing shells which provide the sound damper housing 14. In order to achieve a gas-tight and stable connection, the sound damper connection pipe 42 can be securely connected to the sound damper housing 14 by welding in the first pipe end region 44 thereof.

In a second pipe end region 48 which is located in the housing interior 24, the sound damper connection pipe 42 is supported on a plate-like support element 50. The plate-like support element 50 forms an integral component of the intermediate wall 30. The intermediate wall 30 is, for example, similarly to the other intermediate walls 26 and 28, provided as a sheet metal formed member and has a substantially planar intermediate wall member 52 which is located in an intermediate wall plane E. In the external circumferential region thereof, the intermediate wall member 52 can be surrounded by an axially bent-away edge 54, with which the intermediate wall 30 is retained on the circumferential wall 18 of the sound damper housing 14.

In a bending region 56, the support element 50 adjoins the wall member 52 of the intermediate wall 30 or is bent away thereby so that the substantially plate-like support element 50 extends substantially orthogonally from the intermediate wall plane E and consequently substantially parallel with the longitudinal housing axis G and is positioned orthogonally to a longitudinal pipe axis R of the sound damper connection pipe 42.

In order to provide the support element 50 as an integral component of the intermediate wall 30, a substantially U-shaped cutout can be formed in the wall member 52 of the intermediate wall 30 so that the support element 50 has a connection to the wall member 52 only in the bending region 56.

Figure 3A:
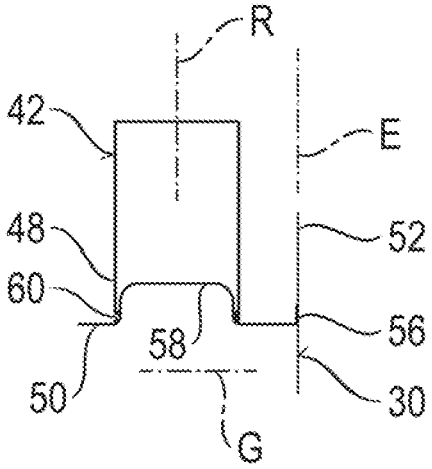
FIGS. 3A and 3B show illustrations of alternative configurations of the connection of a sound damper connection pipe to a support element; and, FIG. 4 shows another alternative embodiment of the connection of a sound damper connection pipe to a support element.
Figure 3B:
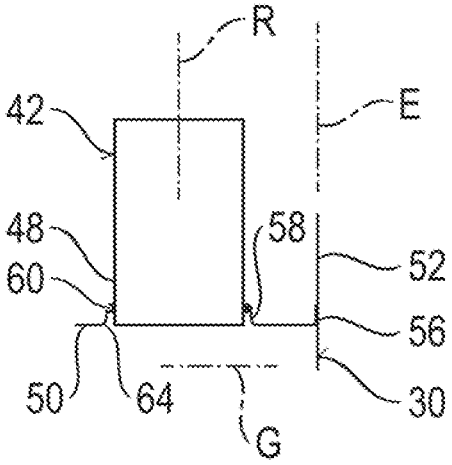

In order to be able to retain or position the second pipe end region 48 of the sound damper connection pipe 42 in a defined manner with respect to the support element 50, the support element 50 may have, as illustrated in FIGS. 3A and 3B, a formation region 58. In the embodiment of FIG. 3A, the formation region 58 is constructed in a cupola-like manner and has such dimensions that it can be positioned so as to engage in the second pipe end region 48 of the sound damper connection pipe 42. Consequently, a positive-locking connection which produces a defined positioning of the sound damper connection pipe 42 with respect to the support element 50 is produced substantially orthogonally to the longitudinal pipe axis R. In order to additionally achieve a stable connection which in particular also prevents rattling noise, the second pipe end region 48 can be fixed by a weld 60 to the support element 50. This weld 60 may be a weld seam which extends in a circumferential direction around the longitudinal pipe axis R, but may also include a plurality of discrete point-like or line-like weld regions which are located in a circumferential direction around the longitudinal pipe axis R with spacing from each other.

FIG. 3A shows that, as a result of the formation region 58, the sound damper connection pipe 42 is substantially closed in the second pipe end region 48 thereof so as to prevent the discharge of exhaust gas. This means that exhaust gas which is introduced into the sound damper 10 via the sound damper connection pipe 42 can be introduced into the housing interior 24 in the region of the chamber 36 only through a perforation 62 which is formed in the sound damper connection pipe 42. If an axial introduction with respect to the longitudinal pipe axis R into the chamber 36 is also necessary, it is possible to provide one or more openings which permit the passage of exhaust gas in the cupola-like or dome-like formation region 58.

In the embodiment illustrated in FIG. 3B, for example, the formation region 58 is in the form of a passage which forms an opening 64 for receiving the second pipe end region 48 of the sound damper connection pipe 42. The second pipe end region 48 can be introduced in this opening 64 and can be securely retained therein by the weld 60.

In order to direct away the exhaust gas which is introduced via the sound damper connection pipe 42 into the housing interior 24, an additional sound damper connection pipe 66, which acts as an outlet pipe and which is received, for example, in the region of the circumferential wall 18 in an opening which is formed in the sound damper housing 14 and which is fixed in this region, for example, by welding to the sound damper housing 14, can be provided. In the illustrated embodiment, the additional sound damper connection pipe 66 extends through the three intermediate walls 26, 28, 30 and is open toward the chamber 38.

In this context, it may also be noted that the extent of such an additional connection pipe and the connection thereof to the sound damper housing 14 could be configured differently from what is illustrated in the figures. It is also possible for the additional sound damper connection pipe 66 to be used as an inlet pipe while the sound damper connection pipe 42 is used as an outlet pipe. Furthermore, it is evident that a plurality of such sound damper connection pipes 42 which are supported in the respective second pipe end region via a support element 50 which is constructed integrally with an intermediate wall may be provided. To this end, such a support element which is integrally connected therewith could be provided on an additional intermediate wall or two support elements which extend in opposite directions from the wall member thereof can be provided on an intermediate wall.

In an additional construction variant, the formation region which is formed on the support element 50 could have a plurality of portions which are arranged in a radially offset manner relative to each other with respect to the longitudinal pipe axis R, wherein some of these portions engage in the sound damper connection pipe 42 and consequently support it from a radially internal position, and some of the portions are located radially outside the sound damper connection pipe 42 and consequently support it from a radially external position. Such portions may, for example, be provided as circumferential portions, which are located in a manner radially offset relative to each other, of the formation region which is in the form of a passage and which is illustrated in FIG. 3B.

Finally, a configuration of the support element 50 is also possible, wherein it is constructed substantially without any formation so that the sound damper connection pipe 42 abuts it with the second pipe end region 48 thereof in a substantially obtuse manner and is fixed by the weld 60.

Figure 4:
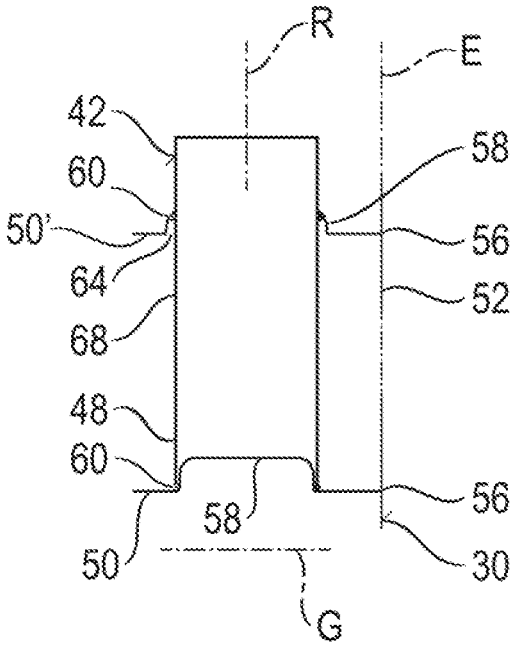

Another alternative construction variant is illustrated in FIG. 4. In this construction variant, the sound damper connection pipe 42 is supported not only in the second pipe end region 48 thereof by a support element 50 which is integrally constructed on the intermediate wall 30, but also in an intermediate region 68 which is located between the two pipe end regions 44, 48. In this configuration, the intermediate wall 30 has a plurality of support elements 50, 50', in the embodiment illustrated two, which are successive in the direction of the longitudinal pipe axis R and which are bent out of the plane E in respective bending regions 56.

The support element 50 provided in association with the second pipe end region 48 can, as illustrated in FIG. 3A, have a formation region 58 which engages in the second pipe end region 48 or can, as illustrated in FIG. 3B, have a formation region 58 which engages [round] around the second pipe end region 48.

The support element 50' which is provided in association with the intermediate region 68 has a formation region 58 which engages round the intermediate region 68 and which has an opening 64 which receives the sound damper connection pipe 42. In this region, a very stable connection can also be achieved in that the support element 50 is connected in a materially engaging manner to the sound damper connection pipe 42, for example, by welding.

It is understood that the foregoing description is that of the preferred embodiments of the invention and that various changes and modifications may be made thereto without departing from the spirit and scope of the invention as defined in the appended claims.

The invention claimed is:

1. A sound damper for an exhaust gas system of an internal combustion engine, the sound damper comprising:

a sound damper housing defining a housing interior;

at least one intermediate wall arranged in said housing interior;

at least one sound damper connection pipe having first and second pipe end regions;

a plate-like support element arranged in said housing interior and being formed as an integral component of said at least one intermediate wall;

said at least one sound damper connection pipe being supported in said first pipe end region on said sound damper housing and being arranged in said second pipe end region on said support element for introducing exhaust gas into said housing interior or for directing exhaust gas out of said housing interior;

wherein:

said at least one intermediate wall defines an intermediate wall plane and includes a wall member located in said intermediate wall plane;

said support element extends from said wall member out of said intermediate wall plane;

said support element and said wall member conjointly define a bending region whereat said support element adjoins said wall member and is bent out of said intermediate wall plane in said bending region; and, for providing said support element as said integral component of said at least one intermediate wall, a U-shaped cut out is formed in said wall member of said at least one intermediate wall and said support element being bent out of said intermediate wall plane has a connection to said wall member only in said bending region.

2. The sound damper of claim 1, wherein said support element extends orthogonally to said intermediate wall plane.

3. The sound damper of claim 1, wherein said sound damper housing includes a circumferential wall elongated in a direction of a longitudinal housing axis and first and second end walls at respective axial ends of said circumferential wall; and, said intermediate wall plane is arranged orthogonally to said longitudinal housing axis.

4. The sound damper of claim 1, wherein said at least one sound damper connection pipe defines a longitudinal pipe axis and is elongated in a direction of said longitudinal pipe axis; and, said support element extends orthogonally to said longitudinal pipe axis.

5. The sound damper of claim 4, wherein said longitudinal pipe axis extends parallel to said intermediate wall plane.

6. The sound damper of claim 1, wherein said support element defines a formation region and said formation region engages in accordance with at least one of the following:

i) around said second pipe end region of said at least one sound damper connection pipe; and, ii) in said second pipe end region of said at least one sound damper connection pipe.

7. The sound damper of claim 6, wherein said at least one sound damper connection pipe is closed off at said second pipe end region thereof by said formation region engaging in said second pipe end region.

8. The sound damper of claim 1, wherein said at least one sound damper connection pipe is closed by said support element at said second pipe end region thereof.

9. The sound damper of claim 8, wherein said support element defines a formation region; and, said at least one sound damper connection pipe is closed off at said second pipe end region thereof by said formation region engaging in said second pipe end region.

10. The sound damper of claim 1, wherein said at least one sound damper connection pipe is fixed in said second pipe end region thereof to said support element by material engagement.

11. The sound damper of claim 10, wherein said material engagement is by welding.

12. The sound damper of claim 1, wherein said sound damper housing has an opening; and, at least one of the following applies:

i) said at least one sound damper connection pipe is received with said first pipe end region thereof in said opening of said sound damper housing; and, ii) said at least one sound damper connection pipe is fixed in said first pipe end region thereof by material engagement to said sound damper housing.

13. The sound damper of claim 12, wherein said material engagement is by welding.

14. The sound damper of claim 1, wherein said sound damper connection pipe is supported between said first pipe end region and said second pipe end region thereof by at least one additional support element which forms an integral component of said intermediate wall.

15. The sound damper of claim 14, wherein said at least one additional support element has a formation region engaging around said sound damper connection pipe.

16. An exhaust gas system for an internal combustion engine of a vehicle, the exhaust gas system comprising at least one sound damper including:

a sound damper housing defining a housing interior;

at least one intermediate wall arranged in said housing interior;

at least one sound damper connection pipe having first and second pipe end regions;

a plate-like support element arranged in said housing interior and being formed as an integral component of said at least one intermediate wall;

said at least one sound damper connection pipe being supported in said first pipe end region on said sound damper housing and being arranged in said second pipe end region on said support element for introducing exhaust gas into said housing interior or for directing exhaust gas out of said housing interior;

wherein:

said at least one intermediate wall defines an intermediate wall plane and includes a wall member located in said intermediate wall plane;

said support element extends from said wall member out of said intermediate wall plane;

said support element and said wall member conjointly define a bending region whereat said support element adjoins said wall member and is bent out of said intermediate wall plane in said bending region; and, for providing said support element as said integral component of said at least one intermediate wall, a U-shaped cut out is formed in said wall member of said at least one intermediate wall and said support element being bent out of said intermediate wall plane has a connection to said wall member only in said bending region.

* * * * *